United States Patent [19]

Taylor

[11] Patent Number: 4,466,569

[45] Date of Patent: Aug. 21, 1984

[54] ANCHORING A RAILWAY RAIL-FASTENING CLIP TO A FOUNDATION FOR A RAILWAY RAIL

[75] Inventor: Howard P. J. Taylor, Grantham, England

[73] Assignee: Pandrol Limited, London, England

[21] Appl. No.: 311,636

[22] Filed: Oct. 15, 1981

[30] Foreign Application Priority Data

Oct. 15, 1980 [GB] United Kingdom ..... 8033257

[51] Int. Cl.[3] ..... E01B 9/30

[52] U.S. Cl. ..... 238/1; 52/698; 238/310; 238/349

[58] Field of Search ..... 238/83, 84, 265, 310, 238/315, 338, 349, 351, 1; 52/295, 698, 712, 714, 740

[56] References Cited

U.S. PATENT DOCUMENTS

| | | | |
|---|---|---|---|
| 1,052,246 | 2/1913 | Hammons | 52/714 |
| 1,428,327 | 9/1922 | Girolami | 52/714 X |
| 2,257,077 | 9/1941 | Scholes | 238/349 |
| 3,004,715 | 10/1961 | Gadd | 238/287 |
| 3,719,342 | 3/1973 | Kubersmit | 52/714 X |
| 3,894,687 | 7/1975 | Jacobson | 238/310 |
| 3,957,201 | 5/1976 | Johnson et al. | 238/298 |
| 4,275,832 | 6/1981 | Kenyon | 238/310 |
| 4,306,677 | 12/1981 | Fischer | 238/349 |

FOREIGN PATENT DOCUMENTS

| | | | |
|---|---|---|---|
| 183553 | 10/1955 | Austria | 52/698 |
| 1021751 | 11/1977 | Canada | 238/349 |
| 7813 | 2/1980 | European Pat. Off. | 238/349 |
| 800037 | 8/1950 | Fed. Rep. of Germany . | |
| 939157 | 2/1956 | Fed. Rep. of Germany . | |
| 2314144 | 10/1974 | Fed. Rep. of Germany . | |
| 7637470 | 6/1977 | Fed. Rep. of Germany . | |
| 2365003 | 4/1978 | France . | |
| 790068 | 2/1958 | United Kingdom . | |
| 829019 | 2/1960 | United Kingdom . | |
| 1039017 | 8/1966 | United Kingdom . | |
| 1096664 | 12/1967 | United Kingdom . | |
| 1095180 | 12/1967 | United Kingdom . | |
| 1278388 | 6/1972 | United Kingdom . | |
| 1347591 | 2/1974 | United Kingdom . | |
| 1394796 | 5/1975 | United Kingdom . | |
| 1445108 | 8/1976 | United Kingdom . | |
| 1528241 | 10/1978 | United Kingdom . | |
| 1534635 | 12/1978 | United Kingdom . | |
| 1557315 | 12/1979 | United Kingdom . | |
| 2047779 | 12/1980 | United Kingdom . | |

*Primary Examiner*—Randolph Reese

*Attorney, Agent, or Firm*—Norbert P. Holler; Charles A. Blank

[57] ABSTRACT

An anchoring device for use in anchoring a railway rail-fastening clip to a foundation for a railway rail has a head part, which anchors the clip and is to lie above the foundation, and a tail part which is to lie in the foundation and is in the form of a single vertical rod. At least one vane, to resist turning of the device about its vertical axis, has its upper extremity joined to the bottom of the head part and has one of its sides joined to the upper portion of the tail part, the vane having a vertical length and a horizontal width greater than its horizontal thickness. At least one projection, below the vane or vanes, projects laterally from the tail part and has a horizontal or nearly horizontal top, the projection or projections serving to resist vertical forces tending to pull the anchoring device vertically upwardly out of the foundation.

A concrete rail tie may have the tail parts of four of such anchoring devices embedded in it and a railway rail-and-fastening assembly may comprise a concrete foundation, a rail lying on it between the head parts of two such anchoring devices and two clips anchored by the anchoring devices and pressing downwardly on opposite sides of a flange at the bottom of the rail.

18 Claims, 6 Drawing Figures

ANCHORING A RAILWAY RAIL-FASTENING CLIP TO A FOUNDATION FOR A RAILWAY RAIL

According to a first aspect of the invention, there is provided an anchoring device which is suitable for use in anchoring a railway rail-fastening clip to a foundation for a railway rail, the device comprising, when considered while in a particular orientation: a head part which is to lie above the foundation; portions of the head part constructed to anchor a railway rail-fastening clip; a tail part which is joined to the head part and is to lie in the foundation and is in the form of a single vertical rod below the head part; a vane, for resisting forces tending to turn the anchoring device about a vertical axis, joined along its upper extremity to the bottom of the head part and joined along one side thereof to one side of the upper portion of the tail part, the vane having an overall vertical height and an overall horizontal width which are both greater than its average horizontal thickness; and a projection, for resisting forces tending to pull the anchoring device vertically out of the foundation, projecting laterally from the tail part at a location lower than the vane, the top of the projection extending, from the root of the projection towards its tip, at, at most, a small angle to the horizontal.

Said portions of the head part may define a horizontal straight passageway, for example of circular cross-section, in the head part, into which can be driven a substantially straight and horizontal leg of a railway rail-fastening clip which has been made by bending a metal rod, for example of circular cross-section. The clips may be as shown in U.S. Pat. Nos. 3,297,253, 3,658,246 or 4,073,435.

Preferably, there is a second vane joined along its upper extremity to the bottom of the head part and joined along one side thereof to the side of the upper portion of the tail part which is opposite to said one side of the upper portion of the tail part, the second vane also having an overall vertical height and an overall horizontal width which are both greater than its average horizontal thickness, and the two vanes extending in opposite directions away from the tail part and the median vertical planes of the two vanes being coincident. If the head part includes the above-mentioned passageway, the coincident median vertical planes preferably contain its axis.

Figure 5:
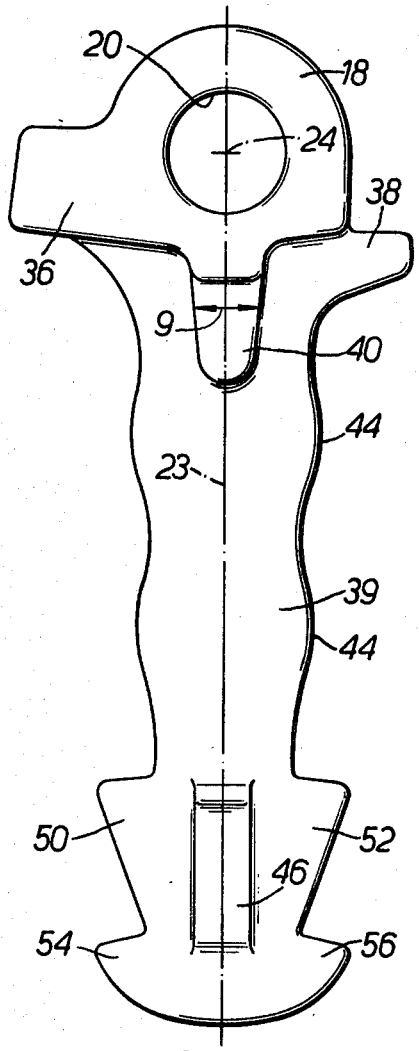
Figure 6:
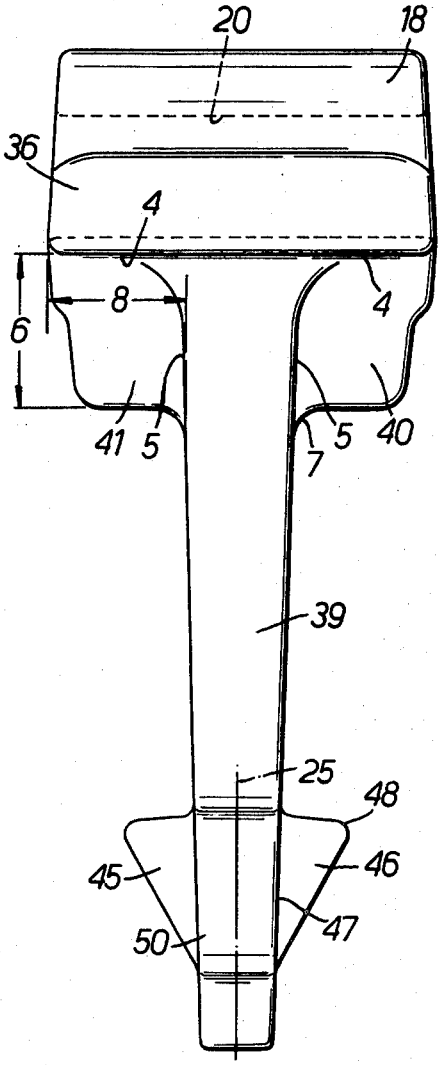

There is preferably a second projection, for resisting forces tending to pull the anchoring device vertically out of the foundation, projecting laterally from the tail part at a location lower than the vane, the top of the projection extending, from the root of the projection towards its tip, at, at most, a small angle to the horizontal, said second projection extending from that side of the tail part which is opposite to that side from which the first-mentioned projection extends and the two projections extending in opposite directions away from the tail part. If there are both the two vanes and the two projections, the directions in which the two vanes extend away from the tail part are preferably perpendicular to the directions in which the two projections extend away from the tail part. An example of this is shown in FIGS. 5 and 6 of the accompanying drawings (vanes 40 and 41 and projections 50 and 52).

There may be, in addition to the first-mentioned and second projections extending in opposite directions away from the tail part, third and fourth projections, each as specified above for the first-mentioned projection, extending from opposite sides of the tail part in opposite directions which are perpendicular to the directions in which the first and second projections extend from the tail part. An example of this is also shown in FIGS. 5 and 6 of the accompanying drawings (projections 50 and 52 and projections 45 and 46), which also show that the four projections may also be at the same vertical distance below the head part.

There may be at least one projection, as specified above for the first-mentioned projection, at a greater distance than is the first-mentioned projection from the head part. Thus there may be an upper pair of oppositely-directed projections and a lower pair of oppositely-directly projections, all having coincident median planes. See FIG. 5 of the accompanying drawings (projections 50 and 52 and projections 54 and 56) which also shows another pair of oppositely-directed projections (45 and 46) having coincident median planes perpendicular to the median planes of the projections 50, 52, 54 and 56.

The top of the first-mentioned projection or of each projection may extend, from the root of the projection to its top, horizontally or at a small angle, no more than 20°, to the horizontal, preferably downwardly.

The first-mentioned projection or each or some of the projections may be of saw-tooth form.

According to a second aspect of the invention, there is provided a concrete rail tie comprising four anchoring devices according to the first aspect of the invention with their tail parts embedded in the concrete and their head parts above the concrete.

According to a third aspect of the invention, there is provided a railway rail-and-fastening assembly comprising a concrete foundation for a railway rail; a railway rail lying on the foundation, the rail having a flange at its bottom; two anchoring devices according to the first aspect of the invention with their tail parts embedded in the concrete and their head parts above the concrete on opposite sides of the rail; and two railway rail-fastening clips each having one portion anchored by the head part of one of the devices and pressing upwardly on it, another portion bearing downwardly on the top of said flange and a third portion bearing downwardly on said head part at a location which is beyond said one portion, as seen from the rail.

Figure 1:
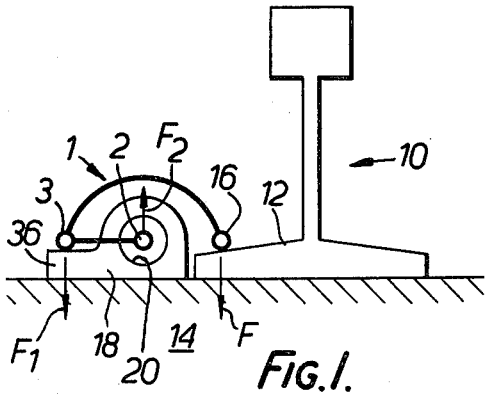
Figure 2:
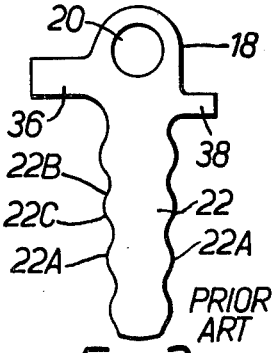
Figure 3:
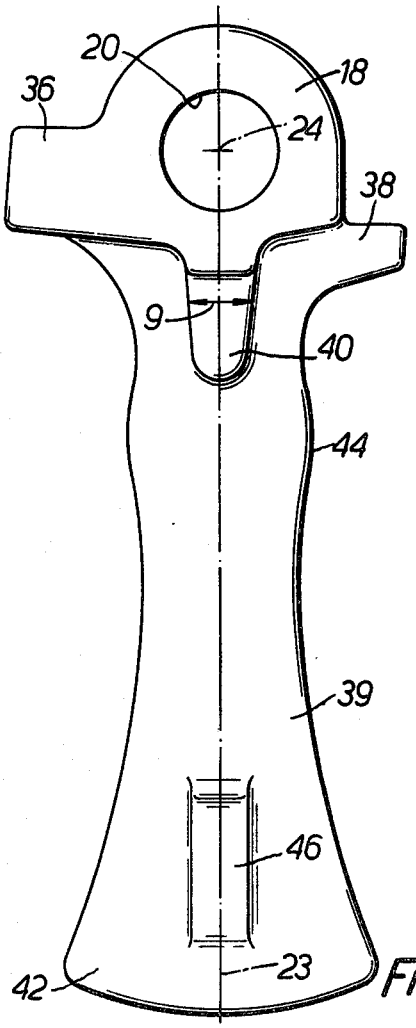
Figure 4:
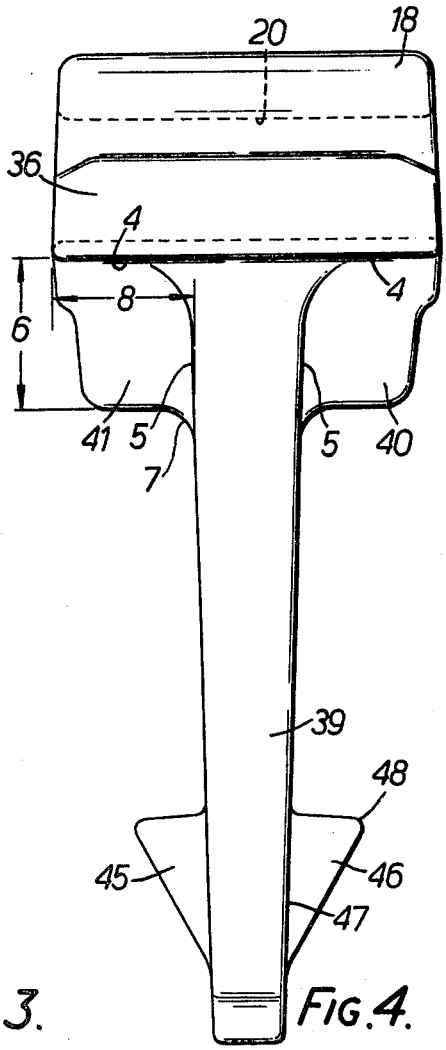

Examples in accordance with the invention are described below with reference to the accompanying drawings, in which:

FIG. 1 diagrammatically shows part of a concrete rail tie according to the second aspect of the invention and part of a railway rail-and-fastening assembly according to the third aspect of the invention, FIG. 2 shows a conventional clip-anchoring device which has hitherto been included in a rail tie and an assembly as shown in FIG. 1, FIGS. 3 and 5 show side elevations of a first and a second clip-anchoring device according to the first aspect of the invention, and FIGS. 4 and 6 show further side elevations of the devices according to FIGS. 3 and 5, respectively.

FIG. 1 shows a head part 18 of a clip-anchoring device which has joined to it a tail part which is embedded in a concrete rail tie 14. A railway rail 10 has a flange 12 at its base and this lies between, and is located by, the illustrated head part 18 and the head part 18 of a similar clip-anchoring device (not shown). There are two further such clip-anchoring devices (not shown) further to the right, with the flange of the other rail lying between the head parts and with their tail parts embedded in the concrete tie. A railway rail-fastening clip 1 as shown in U.S. Pat. No. 4,073,435, made by bending a steel bar of circular cross-section, has its substantially straight leg 2 lying in a horizontal passageway 20, also of circular cross-section, through the head part 18 and pressing upwardly with a force $F_2$ on the roof of the passageway. A portion 3 of the clip presses downwardly with a force $F_1$ on a ledge 36 on the anchoring device and a portion 16 of the clip bears downwardly with a force F on the top of one side of the flange 12. A similar clip holds down the other side of the flange 12 and two more such clips hold down the other rail on the same tie.

The conventional clip-anchoring device shown in FIG. 2 has a ledge 38 which helps locate the clip-anchoring device in a mold in which the concrete is cast. The tail part 22 of the clip-anchoring device is in the form of a vertical rod which has rounded projections 22A, the upper flanks 22B and lower flanks 22C of which are inclined by large angles (more than 60°) to the horizontal. The projections are intended to prevent the clip-anchoring device moving vertically upwardly but experience has shown that vibration sometimes causes the surrounding concrete to crack and the clip-anchoring device to move vertically upwardly. There is also a tendency for the concrete to crack due to forces tending to turn the clip-anchoring device about the vertical axis of the tail part 22, despite the presence of the ledge 38 which opposes, to a very limited extent, such turning.

In order to resist to a greater extent forces tending to turn the clip-anchoring device about the vertical axis, each of the devices shown in FIGS. 3 to 6 has two vanes 40 and 41, each of which is joined along its upper extremity 4 to the bottom of the head part 18, which again has a ledge 36 and a passageway 20 through it; there is again another ledge 38. Each vane 40 and 41 is also joined along one side 5 to the rod-like tail part 39 of the clip-anchoring device. The opposite faces of the two vanes are planar but not parallel to each other.

The overall vertical height 6 of each vane, disregarding a fillet 7 at the bottom of the vane, is more than 1½ cm. and in fact about 2.5 cm., which is about a fifth of the length of the tail part 39, and the overall horizontal width 8 of each vane is more than 1½ cm. and in fact about 2.5 cm., i.e. both dimensions are greater than the average horizontal thickness 9 of the vane, which is less than 1¼ cm. and in fact about 1.0 cm. Thus the total area of each vane as seen in FIGS. 4 and 6 is very much greater than the area of the ledge 38 as seen in FIG. 2 and presents a much greater opposition to turning of the clip-anchoring device about its vertical axis.

In each case the thickness of the tail part 39 reduces, proceeding from top to bottom, as shown in FIGS. 4 and 6, and there are rounded projections 44, somewhat like the projections 22A of FIG. 2, below the vanes 40 and 41. Lower still, there are in each case planar projections 45 and 46, each of saw-tooth form, with their upper flanks sloping downwardly from their roots 47 to their tips 48 at a very small angle, less than 5°, to the horizontal. The plane 23 is the median plane of each of the vanes 40 and 41 and of each of the projections 45 and 46 and it contains the axis 24 of the passageway 20.

In the case shown in FIGS. 3 and 4, the projections 45 and 46, extending away from the tail part 39 in opposite directions, are the only such projections and the width of the lower end 42 of the tail part 39 is greater than the width of the tail part half-way up its length, or indeed at any level below the ledge 38, there being a smooth transition in width from the lower end 42 to the level half-way up the length of the tail part 39.

In the case shown in FIGS. 5 and 6 there are two further planar projections 50 and 52, also of saw-tooth form, extending in opposite directions away from the tail part 39, with their upper surfaces also sloping downwardly at a very small angle to the horizontal, proceeding from the roots to the tips of the projections. These projections have a common median plane 25 which is perpendicular to the plane 23 and the tops of all the projections 45, 46, 50 and 52 are at equal distances below the head part 18. There are two further planar projections 54 and 56 at the bottom of the tail part 39, extending in opposite directions away from it and having the plane 25 as their common median plane. These projections have their tops inclined to the horizontal by a larger angle than the other projections 45, 46, 50 and 52, but still less than 20°, as they slope downwardly from the roots to the tips of the projections. Their under-sides are rounded.

Each of the clip-anchoring devices shown in FIGS. 3 to 6 is a single piece of cast spheroidal graphite iron. Each vane in each clip-anchoring device has a horizontal lower side, the horizontal width of which is preferably, and as shown, greater than the average horizontal thickness of the vane. Each vane has, at a level halfway up its height 6, a horizontal width, measured parallel to the overall width 8, which is substantially more than half the width, again measured parallel to the overall width 8, of the vane at the top of the vane. These features distinguish the shape of the vane from a triangular shape.

I claim:

1. An anchoring device which is suitable for use in anchoring a railway rail-fastening clip to a foundation for a railway rail, the device comprising, when considered while in a particular orientation: a head part which is to lie above the foundation; portions of the head part defining a horizontal straight passageway in the head part, into which can be driven a substantially straight and horizontal leg of a railway rail-fastening clip which has been made by bending a metal rod; a tail part which is joined to the head part and is to lie in the foundation and is in the form of a single vertical rod below the head part; a vane, for resisting forces tending to turn the anchoring device about a vertical axis, joined along its upper extremity to the bottom of the head part and joined along one side thereof to one side of the upper portion of the tail part, the vane having an overall vertical height and an overall horizontal width which are both greater than its average horizontal thickness and the vane having a median vertical plane to which the length direction of the passageway is parallel; and a projection, for resisting forces tending to pull the anchoring device vertically out of the foundation, projecting laterally from the tail part at a location lower than the vane, the top of the projection extending, from the root of the projection towards its tip, at, at most, a small angle to the horizontal.

2. A device according to claim 1 and further comprising a second vane joined along its upper extremity to the bottom of the head part and joined along one side thereof to the side of the upper portion of the tail part which is opposite to said one side of the upper portion of the tail part, the second vane also having an overall vertical height and an overall horizontal width which are both greater than its average horizontal thickness, and the two vanes extending in opposite directions away from the tail part and the median vertical planes of the two vanes being coincident.

3. A device according to claim 2 and further comprising a second projection, for resisting forces tending to pull the anchoring device vertically out of the foundation, projecting laterally from the tail part at a location lower than the vanes, the top of the projection extending, from the root of the projection towards its tip, at, at most, a small angle to the horizontal, said second projection extending from that side of the tail part which is opposite to that side from which the first-mentioned projection extends and the two projections extending in opposite directions away from the tail part, these directions being perpendicular to the directions in which the two vanes extend away from the tail part.

4. A device according to claim 1 and further comprising a second vane joined along its upper extremity to the bottom of the head part and joined along one side thereof to the side of the upper portion of the tail part which is opposite to said one side of the upper portion of the tail part, the second vane also having an overall vertical height and an overall horizontal width which are both greater than its average horizontal thickness, and the two vanes extending in opposite directions away from the tail part and the median vertical planes of the two vanes being coincident and containing the axis of said passageway.

5. A device according to claim 1 in which said projection is substantially of saw-tooth form.

6. A device according to claim 1 and further comprising a second projection, for resisting forces tending to pull the anchoring device vertically out of the foundation, projecting laterally from the tail part at a location lower than the vane, the top of the projection extending, from the root of the projection towards its tip, at, at most, a small angle to the horizontal, said second projection extending from that side of the tail part which is opposite to that side from which the first-mentioned projection extends and the two projections extending in opposite directions away from the tail part.

7. A device according to claim 6 and further comprising third and fourth projections, for resisting forces tending to pull the anchoring device vertically out of the foundation, projecting laterally from the tail part at a location lower than the vane, the top of the projection extending, from the root of the projection towards its tip, at, at most, a small angle to the horizontal, the third and fourth projections extending from opposite sides of the tail part in opposite directions which are perpendicular to the directions in which the first and second projections extend away from the tail part.

8. A device according to claim 7 in which the third and fourth projections are at the same vertical distance below the head part as are the first and second projections.

9. A device according to claim 1 and further comprising another projection at a greater distance than is the first-mentioned projection from the head part, said another projection being for resisting forces tending to pull the anchoring device vertically out of the foundation and projecting laterally from the tail part at a location lower than the vane, the top of the projection extending, from the root of the projection towards its tip, at, at most, a small angle to the horizontal.

10. A device according to claim 1 and further comprising three more projections, there being an upper pair of oppositely-directed projections and a lower pair of oppositely-directed projections, all having coincident median planes, each of said three more projections being for resisting forces tending to pull the anchoring device vertically out of the foundation and projecting laterally from the tail part at a location lower than the vane, the top of the projection extending, from the root of the projection towards its tip, at, at most, a small angle to the horizontal.

11. A device according to claim 10 and further comprising another pair of oppositely-directed projections having median planes which coincide and are perpendicular to said coincident median planes.

12. A device according to claim 1 in which the tail part is wider at its lower end than it is halfway up its height, there being a smooth transition from the greater width to the lesser width.

13. A concrete railway rail tie comprising four anchoring devices according to claim 1 with their tail parts embedded in the concrete and their head parts above the concrete, the passageways in the head parts being horizontal and extending perpendicularly to the length of the tie.

14. A railway rail-and-fastening assembly comprising a concrete foundation for a railway rail; a railway rail lying on the foundation, the rail having a flange at its bottom; two anchoring devices according to claim 1 with their tail parts embedded in the concrete and their head parts above the concrete on opposite sides of the rail, the passageways in the head parts being horizontal and extending parallel to the length of the rail; and two railway rail-fastening clips each having one portion anchored by the head part of one of the devices and pressing upwardly on it, another portion bearing downwardly on the top of said flange and a third portion bearing downwardly on said head part at a location which is beyond said one portion, as seen from the rail.

15. An anchoring device which is suitable for use in anchoring a railway rail-fastening clip to a foundation for a railway rail, the device comprising, when considered while in a particular orientation: a head part which is to lie above the foundation; portions of the head part constructed to anchor a railway rail-fastening clip; a tail part which is joined to the head part and is to lie in the foundation and is in the form of a single vertical rod below the head part; a vane, for resisting forces tending to turn the anchoring device about a vertical axis, the vane having, midway between its top and its bottom, a horizontal width substantially greater than half its width at the top of the vane and the vane being joined along its upper extremity to the bottom of the head part and joined along one side thereof to one side of the upper portion of the tail part, the vane having an overall vertical height and an overall horizontal width which are both greater than its average horizontal thickness; and a projection, for resisting forces tending to pull the anchoring device vertically out of the foundation, projecting laterally from the tail part at a location lower than the vane, the top of the projection extending, from the root of the projection towards its tip, at, at most, a small angle to the horizontal.

16. An anchoring device which is suitable for use in anchoring a railway rail-fastening clip to a foundation for a railway rail, the device comprising, when considered while in a particular orientation: a head part which is to lie above the foundation; portions of the head part constructed to anchor a railway rail-fastening clip; a tail part which is joined to the head part and is to lie in the foundation and is in the form of a single vertical rod below the head part; a vane, for resisting forces tending to turn the anchoring device about a vertical axis, the vane having a substantially horizontal lower side and being joined along its upper extremity to the bottom of the head part and joined along one side thereof to one side of the upper portion of the tail part, the vane having an overall vertical height and an overall horizontal width which are both greater than its average horizontal thickness; and a projection, for resisting forces tending to pull the anchoring device vertically out of the foundation, projecting laterally from the tail part at a location lower than the vane, the top of the projection extending, from the root of the projection towards its tip, at, at most, a small angle to the horizontal.

17. An anchoring device which is suitable for use in anchoring a railway rail-fastening clip to a foundation for a railway rail, the device comprising, when considered while in a particular orientation: a head part which is to lie above the foundation; portions of the head part defining a horizontal straight passageway in the head part, into which can be driven a substantially straight and horizontal leg of a railway rail-fastening clip which has been made by bending a metal rod; a tail part which is joined to the head part and is to lie in the foundation and is in the form of a single vertical rod below the head part; two and only two vanes, for resisting forces tending to turn the anchoring device about a vertical axis, each vane being joined along its upper extremity to the bottom of the head part and joined along one side thereof to one side of the upper portion of the tail part, each vane having an overall vertical height and an overall horizontal width which are both greater than its average horizontal thickness and each vane having a median vertical plane to which the length direction of the passageway is parallel; and a projection, for resisting forces tending to pull the anchoring device vertically out of the foundation, projecting laterally from the tail part at a location lower than the vane, the top of the projection extending, from the root of the projection towards its tip, at, at most, a small angle to the horizontal.

18. An anchoring device which is suitable for use in anchoring a railway rail-fastening clip to a foundation for a railway rail, the device comprising, when considered while in a particular orientation: a head part which is to lie above the foundation; portions of the head part defining a horizontal straight passageway in the head part, into which can be driven a substantially straight and horizontal leg of a railway rail-fastening clip which has been made by bending a metal rod; a tail part which is joined to the head part and is to lie in the foundation and is in the form of a single vertical rod below the head part; two and only two vanes, for resisting forces tending to turn the anchoring device about a vertical axis, each vane having a substantially horizontal lower side and being joined along its upper extremity to the bottom of the head part and joined along one side thereof to one side of the upper portion of the tail part, each vane having an overall vertical height, an overall horizontal width and a length of said lower horizontal side which are all greater than its average horizontal thickness, each vane also having a median vertical plane which contains the axis of said passageway; and a projection, for resisting forces tending to pull the anchoring device vertically out of the foundation, projecting laterally from the tail part at a location lower than the vane, the top of the projection extending, from the root of the projection towards its tip, at, at most, a small angle to the horizontal.

* * * * *